US006293684B1

(12) United States Patent
Riblett

(10) Patent No.: US 6,293,684 B1
(45) Date of Patent: Sep. 25, 2001

(54) WAND LIGHT

(76) Inventor: Edward L. Riblett, 780 Cherry St., Suite 1 Winter Park, FL (US) 32789

( * ) Notice: Subject to any disclaimer, the term of this patent is extended or adjusted under 35 U.S.C. 154(b) by 0 days.

(21) Appl. No.: 09/656,722

(22) Filed: Sep. 7, 2000

(51) Int. Cl.[7] ..... F21L 4/02; F21V 33/00

(52) U.S. Cl. ..... 362/184; 362/185; 362/186; 362/102; 362/202; 362/205; 362/206; 362/267; 362/577; 362/249; 200/60

(58) Field of Search ..... 362/184, 185, 362/186, 102, 202, 205, 206, 267, 577, 249; 200/60

(56) References Cited

U.S. PATENT DOCUMENTS

| | | | | |
|---|---|---|---|---|
| 4,600,974 | | 7/1986 | Lew et al. . | |
| 5,036,442 | | 7/1991 | Brown . | |
| 5,060,123 | | 10/1991 | Arnold . | |
| 5,079,679 | | 1/1992 | Chin-Fa . | |
| 5,081,568 | | 1/1992 | Dong et al. . | |
| 5,309,337 | * | 5/1994 | Groben | 362/206 |
| 5,392,203 | | 2/1995 | Harris, Jr. . | |
| 5,622,423 | | 4/1997 | Lee . | |
| 5,697,695 | | 12/1997 | Lin et al. . | |

* cited by examiner

*Primary Examiner*—Thomas M. Sember
*Assistant Examiner*—Ali Alavi
(74) *Attorney, Agent, or Firm*—Edward M. Livingston, Esq.

(57) ABSTRACT

A wand light has a base tube (1) with a light-tube end in which a base end of a light tube (9) is pivotal concentrically with pivotal-light-switch attachment of the light tube to the base tube. The base tube contains a stored-energy unit (2) in addition to being a handle and a daytime signaler. The light tube contains a light emitter which can include a flashlight bulb (35) or a plurality of light-emitting diode units (18) on a circuit board (14). The light tube is twisted in the base tube for selective switching of current for the light emitter. Moisture-proof pivotal attachment of the light tube to the base tube, moisture-proof construction of the light tube and moisture-proof construction of the base tube render the entire wand light moisture-proof. Predetermined ruggedness, diameter, length, diameter per length and length of the light tube per length of the base tube render it adaptable to a wide variety of uses. Accidental and unintentional switching are prevented with twist switching. Daytime signaling is provided by appropriate coloring and brightness of coloring of the base tube while being handheld with the light tube. Nighttime signaling is provided by appropriate coloring and brightness of coloring of the light tube and the light emitters while being handheld with the base tube.

27 Claims, 3 Drawing Sheets

WAND LIGHT

BACKGROUND OF THE INVENTION

This invention relates to hand-held lights having cylindrical or rod-shaped transmitters of light used mostly for wand-like signaling and warning.

There are numerous known types and descriptions of signaling rods and lights. A major use is for directing traffic. Particularly in parts of the world with much automobile traffic but inadequate traffic lights and low-cost labor, they are used extensively for human direction of automobile and pedestrian traffic. A predominant use worldwide is at airports for ground crews to direct positioning of aircraft. A wide range of uses is for various warning signals and for broad illumination.

Most early signaling lights were adaptations of flashlights. Later, light emitting diodes (LEDs) became widely used. Then there was a revival of flashlights that were specially designed and structured for signaling rods or wands.

Examples of most-closely related known but yet different wand-like lights are described in the following patent documents. U.S. Pat. No. 5,697,695, issued to Lin, et al. on Dec. 16, 1997, described a "signal stick" with red, yellow and green LEDs that were timed automatically like a traffic light or manually with current from flashlight batteries. U.S. Pat. No. 5,622,423, issued to Lee on Apr. 22, 1997, described a hand-carried traffic-control light having a printed circuit board with a plurality of openings where LEDs were positioned in a transparent tube on an end of a flashlight and having a flashlight bulb at an end of the transparent tube with push-switch control. U.S. Pat. No. 5,392,203, issued to Harris, Jr. on Feb. 21, 1995, described a signal-light assembly with an elongate translucent, brightly colored and watertight tube in which batteries were positioned in a daytime-signal portion for powering a bulb to light a nighttime-signal portion internally. U.S. Pat. No. 5,081,568, issued to Dong, et al. on Jan. 14, 1992, described a police baton with automated or optionally manual switching between red, yellow and green LEDs in a transparent tube on an end of a flashlight for directing traffic. U.S. Pat. No. 5,079,679, issued to Chin-Fa on Jan. 7, 1992, described a multi-purpose directing stick having a battery-operated whistle in an elongate light tube on an end of a flashlight handle. U.S. Pat. No. 5,060,123, issued to Arnold on Oct. 22, 1991, described a flashlight in a policeman's billy club. U.S. Pat. No. 5,036,442, issued to Brown on Jul. 30, 1991, described an illuminated wand with optional hooks on ends for attachment to objects like wheels.

SUMMARY OF THE INVENTION

Objects of patentable novelty and utility taught by this invention are to provide a wand light which:

can have heavy-duty construction for rigorous use;

can be waterproofed for use in rain, floods and slushy environments;

has protected switching that cannot be activated unintentionally or accidentally;

has a handle portion that is optionally bright-colored for daylight signaling;

has a light tube that is optionally clear for lighting with selectively colored LEDs or brightly colored for a selected fixed-color lighting;

is resilience-cushioned against impact damage to electrical components and circuitry;

has optional selectivity of predetermined LED-color lighting; and can be sized adaptively for a plurality of select uses.

This invention accomplishes these and other objectives with a wand light having a base tube with a light-tube end in which a base end of a light tube is pivotal concentrically with pivotal-light-switch attachment of the light tube to the base tube. The base tube contains stored electrical energy, electrical conveyances, pivot-switch electrical contacts and a tubular light-tube attachment. The light tube contains a plurality of LEDs on a circuit board that is predeterminedly transparent and shockproof resilient or, optionally, a flashlight bulb. The light tube is twisted in the base tube for selective switching of current for the LEDs. Waterproof pivotal attachment of the light tube to the base tube, waterproof construction of the light tube and waterproof construction of the base tube render the entire wand light waterproof. Predetermined ruggedness, diameter, length, diameter per length and length of the light tube per length of the base tube render it adaptable to a wide variety of uses. Accidental and unintentional switching are prevented with the twist switching. Daytime signaling is provided by appropriate coloring and brightness of coloring of the base tube while being handheld with the light tube. Nighttime signaling is provided by appropriate coloring and brightness of coloring of the light tube and the LEDs while being handheld with the base tube.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are explained briefly as follows:

DESCRIPTION OF PREFERRED EMBODIMENT

Listed numerically below with reference to the drawings are terms used to describe features of this invention. These terms and numbers assigned to them designate the same features throughout this description.

Figure 2:
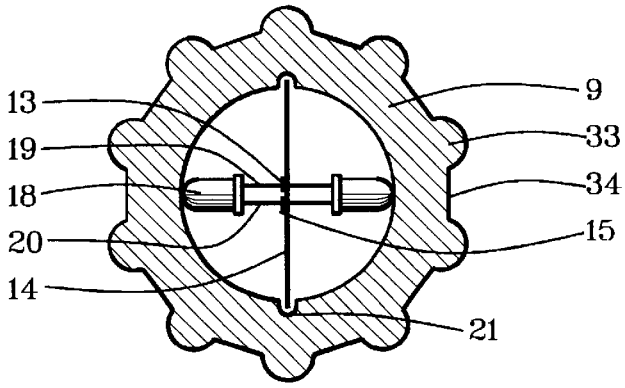
FIG. 2 is an enlarged section view of a FIG. 1 light tube taken through section line 1 in FIG. 1.
Figure 3:
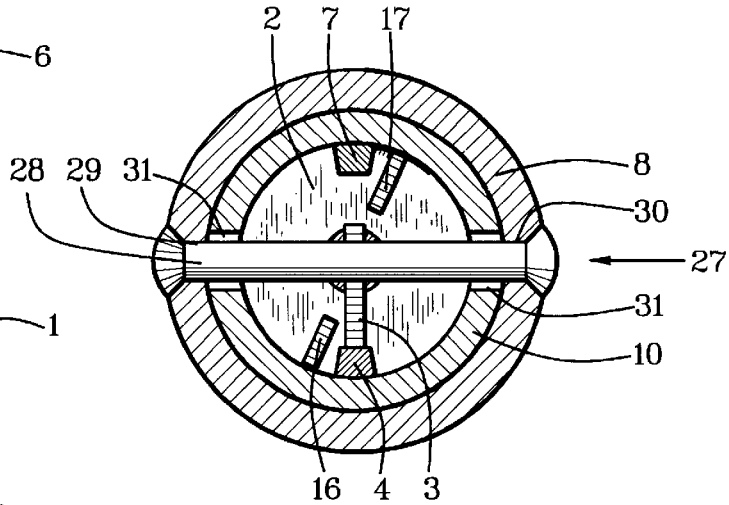
FIG. 3 is an enlarged section view of a twist switch at a pivotal connection of a light tube to a base tube taken through section line 2 in FIG. 1.

1. Base tube
2. Stored-energy unit
3. Positive electrical conveyance
4. Positive contact
5. Twist switch
6. Negative electrical conveyance
7. Negative contact
8. Base sleeve
9. Light tube
10. Light sleeve
11. Positive switch conveyance
12. Negative switch conveyance
13. Positive board conveyance
14. Circuit board
15. Negative board conveyance
16. Positive emitter lead
17. Negative emitter lead
18. LED units
19. First LED leads
20. Second LED leads
21. CB slots
22. Base-tube cap
23. Light-tube cap
24. O-ring
25. Inside O-ring groove
26. Outside O-ring groove
27. Pivot-connection lock
28. Connector pin
29. First base-pin orifice
30. Second base-pin orifice
31. Lock slots
32. LED sequencer
33. Linear ribs
34. Linear grooves
35. Flashlight bulb
36. Reflector
37. Top-end lens
38. First seal cap
39. Second seal cap
40. Machine-threaded bolt Referring first to FIGS. 1–3, a base tube 1 which contains a stored-energy unit 2 has a base end at a bottom and a light-attachment end at a top. A positive electrical conveyance 3 conveys current intermediate a positive portion of the stored-energy unit 2 and at least one positive contact 4 of a twist switch 5 proximate the light-attachment end. A negative electrical conveyance 6 intermediate a negative portion of the stored-energy unit and a negative contact 7 of the twist switch 5 returns the current. The base tube 1, preferably a tough plastic material with desired colorfastness, has a base sleeve 8 with an inside-pivot periphery proximate the light-attachment end.

A light tube 9, preferably a transparent tough plastic material, has a base-attachment end at a bottom and a terminal end at a top. The light tube 9 has a light sleeve 10 with an outside-pivot periphery in sliding pivotal contact with the inside-pivot periphery of the base sleeve 8 proximate the base-attachment end.

A positive switch conveyance 11 and a negative switch conveyance 12 are positioned collinearly in the light sleeve 10 of the light tube 9. The positive switch conveyance 11 is positioned in electrical conveyance intermediate a positive board conveyance 13 on a circuit board 14 and the positive contact 4 of the twist switch by counter rotation of the light tube 9 and the base tube 1. The negative switch conveyance 12 is positioned in electrical conveyance intermediate a negative board conveyance 15 on the circuit board 14 and the negative contact 7 of the twist switch 5 by the counter rotation of the light tube 9 and the base tube 1. A positive emitter lead 16 is in electrical communication intermediate the positive board conveyance 13 and the positive switch conveyance 11. Correspondingly, a negative emitter lead 17 is in electrical communication intermediate the negative board conveyance 15 and the negative switch conveyance 12.

An LED embodiment preferably has a plurality of LED units 18 with first LED leads 19 connected to the positive board conveyance 13 and with second LED leads 20 connected to the negative board conveyance 15. Preferably also, the LED units are staggered on opposite sides of the circuit board 14; the circuit board 14 is thin and flexible for transparency and for resilient shock absorbency; terminal ends of the LED units 18 are buttressed against an internal periphery of the light tube 9 and; edges of the circuit board 14 are positioned in CB slots 21 that are disposed oppositely for linear positioning of the thin and flexible circuit board 14.

A base-tube cap 22 at a base end of the base tube 1 can be provided with selected sealing such as O-rings as shown to represent sealing as such, with circumferential ribs, tapered pipe threading or other means. A light-tube cap 23 also can be provided with sealing to protect electrical components.

Figure 4:
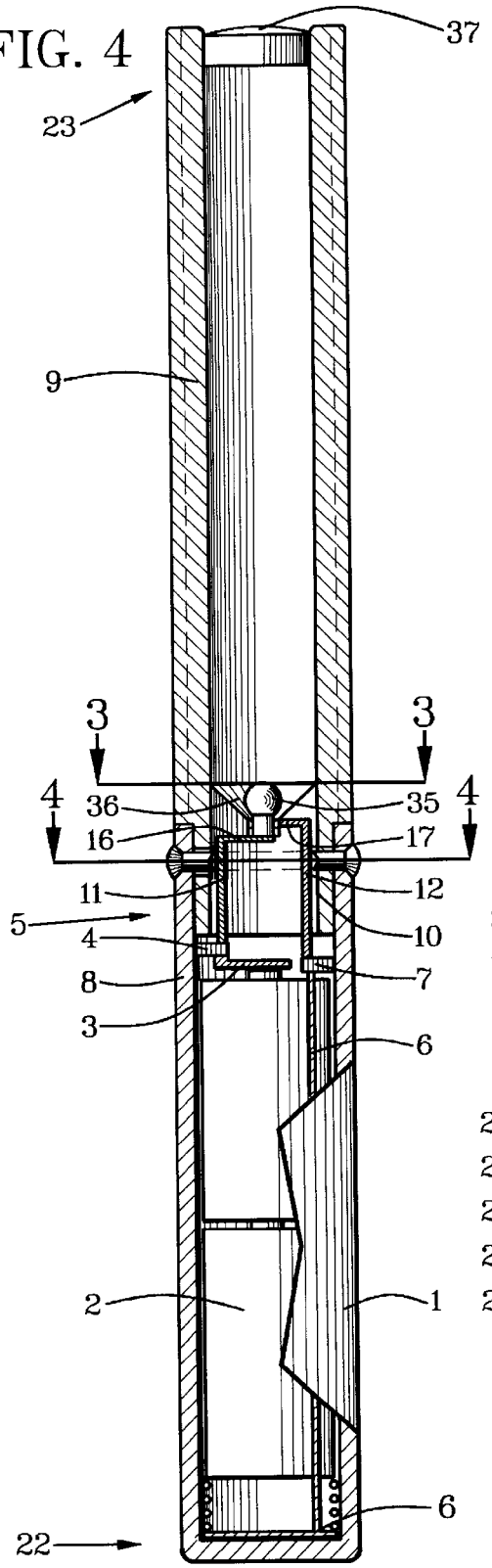
FIG. 4 is a partially cutaway side elevation view of a wand light having a flashlight bulb as a light emitter in the light tube.
Figure 5:
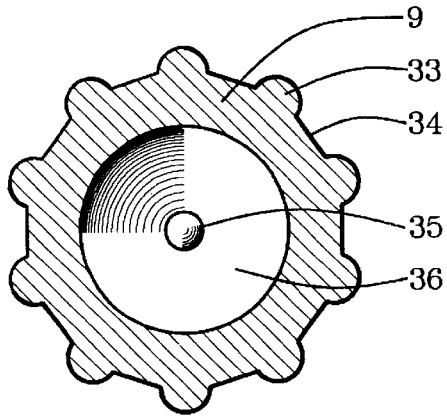
FIG. 5 is an enlarged section view of a FIG. 5 light tube taken through section line 3 in FIG. 5.
Figure 6:
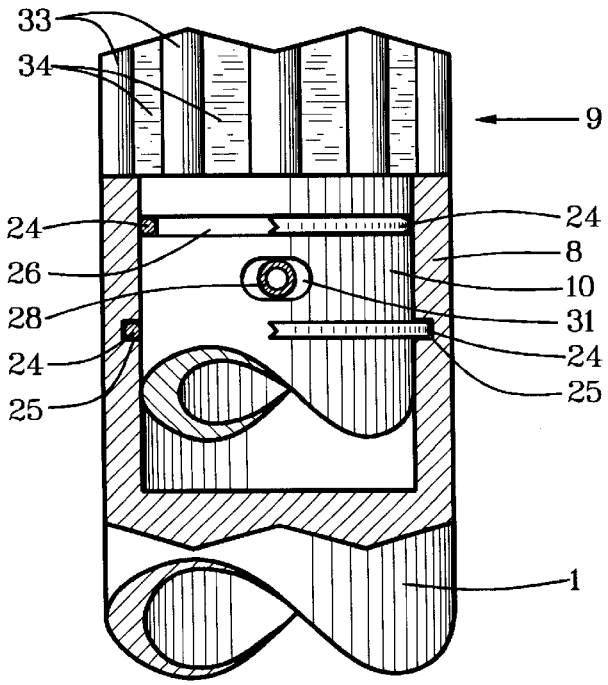
FIG. 6 is an enlarged partially cutaway side view of the twist switch at the pivotal connection of the light tube to the base tube proximate section line 2 in FIG. 1.

The sliding pivotal contact of the outside-pivot periphery of the light sleeve with the inside-pivot periphery of the base sleeve 8 can include moisture-proof sealing with preferably at least one O-ring 24 in either an inside O-ring groove 25 or an outside O-ring groove 26 as shown in FIG. 4.

Included preferably also in the sliding pivotal contact of the outside-pivot periphery of the light sleeve 10 with the inside-pivot periphery of the base sleeve 8 is a pivot-connection lock 27 having a connector pin 28 positioned intermediate a first base-pin orifice 29 and a second base-pin orifice 30 in the base sleeve 8. The light sleeve 10 has two lock slots 31 that are disposed circumferentially opposite to receive the connector pin 28 in circumferential lengths to allow predetermined circumferential travel while preventing linear travel of the light sleeve 10 in the base sleeve 8.

Figure 1:
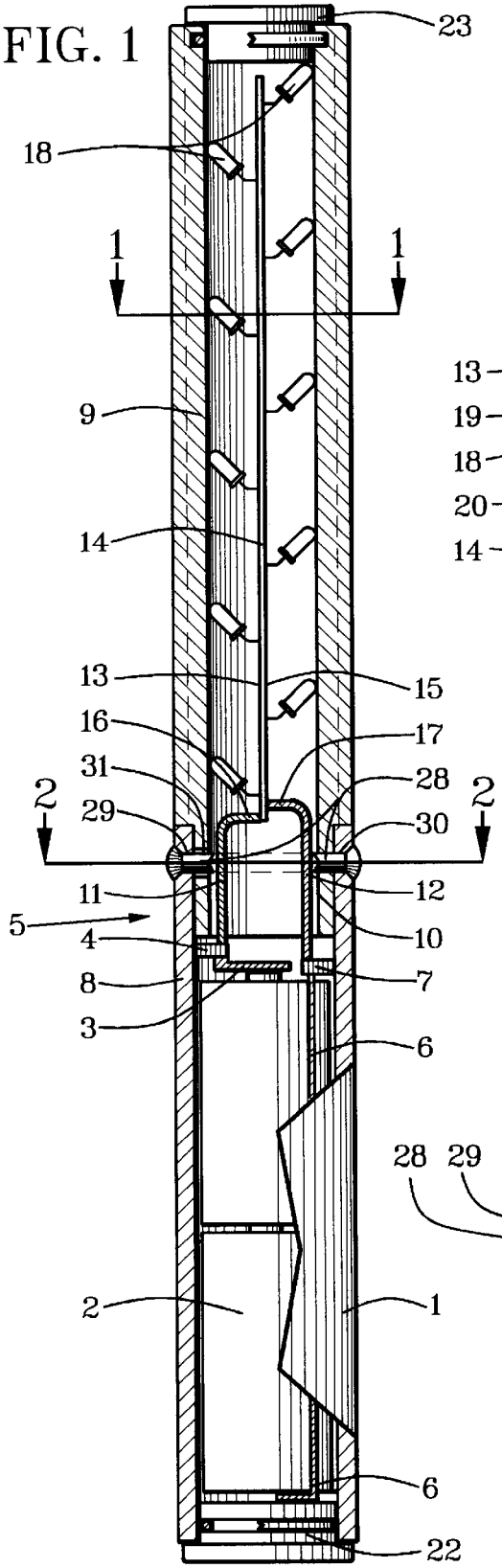
FIG. 1 is a partially cutaway side elevation view of a wand light having a plurality of staggered LEDs on a circuit board.
Figure 8:
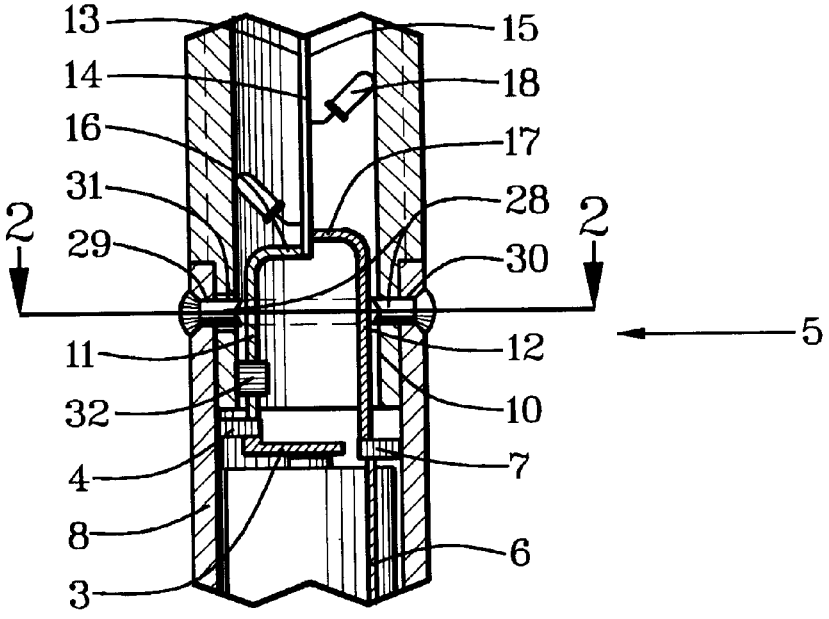
FIG. 8 is a partially cutaway side view of the twist switch having a sequencer for LEDs of the FIG. 1 illustration.

Referring to FIGS. 1 and 8, the LED embodiment can have single-colored or selectively colored LEDs and an LED sequencer 32 intermediate the twist switch 5 and the positive board conveyance 13 for optionally sequential LEDs.

Both ends of this wand light are useable for signaling in all ambient lightness and darkness conditions. Preferably, the base tube 1 is colored for daylight or relatively lightness signaling. The light tube 9 is colored externally and/or internally with colored LEDs for nighttime or relatively darkness signaling.

The light tube 9 preferably has linear ribs 33 and linear grooves 34 to aid hand grasping for counter-rotation switching, to provide structural integrity and to aid in light transmission.

Referring to FIGS. 1 and 4, a light emitter which includes a flashlight bulb 35 as shown in FIG. 4, has the positive emitter lead 16 in positive contact with the flashlight bulb 35 and the negative emitter lead 17 in negative contact with the flashlight bulb 35. The flashlight bulb 35 is optional to a predetermined light-emitting bulb and/or one or more light-emitting diodes, LED units 18. In combination with the flashlight bulb 35 for this wand light can be a reflector 36. Optional also is a top-end lens 37 with directed light conveyance for the light-tube cap 23. The light-tube cap 23 and the base-tube cap 22 can be permanently attached or hermetically sealed for access only through the base sleeve 8 and the light sleeve 10.

Figure 7:
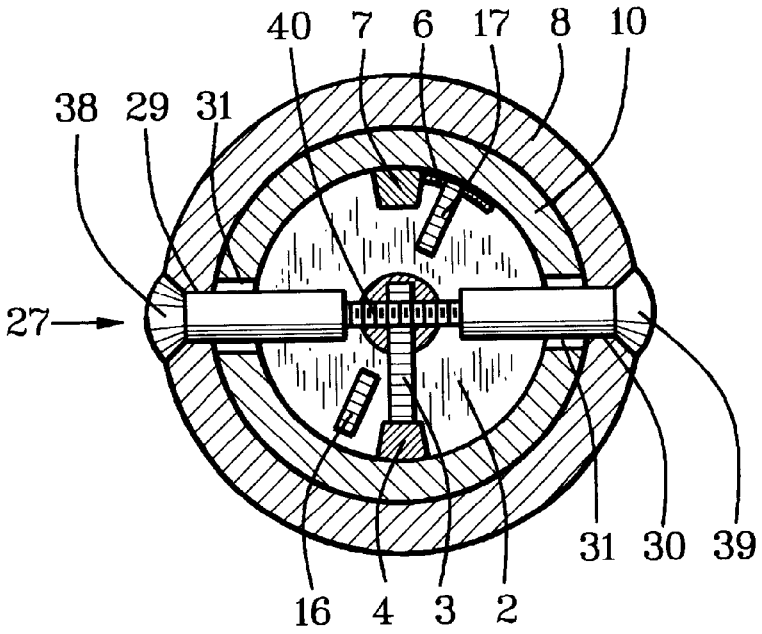
FIG. 7 is an enlarged section view of a twist switch having a tensional connector pin at a pivotal connection of the FIG. 5 light tube to the base tube taken through the section line 4 in FIG. 5.

Referring to FIGS. 1 and 7, the sliding pivotal contact of the outside-pivot periphery of the light sleeve 10 of the light tube 9 with the inside-pivot periphery of the base sleeve 8 of the base tube 1 includes the pivot-connection lock 27 with a tensional connector pin having a first seal cap 38 proximate the first base-pin orifice 29 and a second seal cap 39 proximate the second base-pin orifice 30 with predetermined matching seal structure, including the coned surfaces shown. A tensioner, which can be a machine-threaded bolt 40, for tensioning the first seal cap 38 towards the second seal cap 39 is tensional contractively intermediate the two lock slots 31 for moisture-proof attachment of the tensional connector pin to the base sleeve 8.

A new and useful wand light having been described, all such foreseeable modifications, adaptations, substitutions of equivalents, mathematical possibilities of combinations of parts, pluralities of parts, applications and forms thereof as described by the following claims and not precluded by prior art are included in this invention.

Having thus described my invention, I claim:

1. A wand light comprising:

a base tube having a base end and a light-attachment end;

a stored-energy unit in the base tube;

a positive electrical conveyance intermediate a positive portion of the stored-energy unit and at least one positive contact of a twist switch proximate the light-attachment end;

a negative electrical conveyance intermediate a negative portion of the stored-energy unit and a negative contact of the twist switch proximate the light-attachment end;

the base tube having a base sleeve with an inside-pivot periphery proximate the light-attachment end;

a light tube having a base-attachment end and a terminal end;

the light tube having a light sleeve with an outside-pivot periphery in sliding pivotal contact with the inside-pivot periphery of the base sleeve proximate the base-attachment end;

a positive switch conveyance and a negative switch conveyance positioned collinearly in the light sleeve of the light tube;

a circuit board having at least one positive board conveyance and one negative board conveyance positioned collinearly in the light tube;

a positive emitter lead in electrical communication intermediate the positive board conveyance and the positive switch conveyance;

a negative emitter lead in electrical communication intermediate the negative board conveyance and the negative switch conveyance;

the positive switch conveyance being positioned in electrical conveyance intermediate the positive board conveyance and the positive contact of the twist switch by counter rotation of the light sleeve and the base sleeve;

the negative switch conveyance being positioned in electrical conveyance intermediate the negative board conveyance and the negative contact of the twist switch by the counter rotation of the light sleeve and the base sleeve;

a plurality of LED units having first LED leads connected to the positive board conveyance and having second LED leads connected to the negative board conveyance in the light tube;

the circuit board being predeterminedly transparent, a base-tube cap proximate the base end of the base tube; and a light-tube cap proximate the terminal end of the light tube.

2. The wand light of claim 1, wherein:

the sliding pivotal contact of the outside-pivot periphery of the light sleeve of the light tube with the inside-pivot periphery of the base sleeve of the base tube includes moisture-proof sealing.

3. The wand light of claim 2, wherein:

the moisture-proof sealing includes at least one O-ring in at least one inside O-ring groove in the inside-pivot periphery of the base sleeve.

4. The wand light of claim 2, wherein:

the moisture-proof sealing includes at least one O-ring in at least one outside O-ring groove in the outside-pivot periphery of the light sleeve.

5. The wand light of claim 1, wherein:

the sliding pivotal contact of the outside-pivot periphery of the light sleeve of the light tube with the inside-pivot periphery of the base sleeve of the base tube includes a pivot-connection lock.

6. The wand light of claim 5, wherein:

the pivot-connection lock includes a connector pin positioned intermediate a first base-pin orifice and a second base-pin orifice in the base sleeve;

the light sleeve has two lock slots that are disposed circumferentially opposite to receive the connector pin; and the two lock slots have circumferential lengths to allow predetermined circumferential travel while preventing linear travel of the light sleeve in the base sleeve.

7. The wand light of claim 6, wherein:

the connector pin has moisture-proof attachment to the base sleeve.

8. The wand light of claim 1, wherein:

the base-tube cap is moisture-proof attachable to the base tube to moisture-proof contain the stored-energy unit in the base tube removably.

9. The wand light of claim 1, wherein:

the light-tube cap is moisture-proof attachable to the light tube to moisture-proof contain the circuit board in the light tube.

10. The wand light of claim 1, wherein:

the LED units are a single color.

11. The wand light of claim 1 and further comprising:

an LED sequencer intermediate the twist switch and the positive board conveyance.

12. The wand light of claim 1, wherein:

the base tube has an outside periphery with a color for predetermined lightness visibility.

13. The wand light of claim 1, wherein:

the light tube has an outside periphery with a color for predetermined darkness visibility from light in the light tube.

14. The wand light of claim 1, wherein:

the LED units are stagger-positioned on alternately opposite sides of the circuit board.

15. The wand light of claim 1, wherein:

the light tube has an inside periphery with CB slots oppositely disposed linearly to receive opposite edges of the circuit board.

16. The wand light of claim 15, wherein:

the circuit board is thin and flexible;

the LED units are stagger-positioned on alternately opposite sides of the circuit board; and the LED units have bulb ends that are positioned in sliding contact with the inside periphery of the light tube for predetermined impact resistance and structural integrity.

17. The wand light of claim 1, wherein:

the outside periphery of the light tube has linear ribs and grooves for twist-grasping and for light deflection.

18. A wand light comprising:

a base tube having a base end and a light-attachment end;

a stored-energy unit in the base tube;

a positive electrical conveyance intermediate a positive portion of the stored-energy unit and at least one positive contact of a twist switch proximate the light-attachment end;

a negative electrical conveyance intermediate a negative portion of the stored-energy unit and a negative contact of the twist switch proximate the light-attachment end;

the base tube having a base sleeve with an inside-pivot periphery proximate the light-attachment end;

a light tube having a base-attachment end and a terminal end;

the light tube having a light sleeve with an outside-pivot periphery in sliding pivotal contact with the inside-pivot periphery of the base sleeve proximate the base-attachment end;

a positive switch conveyance and a negative switch conveyance positioned collinearly in the light sleeve of the light tube;

a light emitter having a positive emitter lead connected to the positive switch conveyance and a negative emitter lead connected to the negative switch conveyance in the light tube;

the positive switch conveyance being positioned in electrical communication intermediate the positive emitter lead and the positive contact of the twist switch by counter rotation of the light sleeve and the base sleeve; and the negative switch conveyance being positioned in electrical communication intermediate the negative emitter lead and the negative contact of the twist switch by the counter rotation of the light sleeve and the base sleeve.

19. The wand light of claim 18, wherein:

the light emitter is a light-emitting bulb.

20. The wand light of claim 19, wherein:

the light-emitting bulb includes at least one light-emitting diode.

21. The wand light of claim 19, wherein:

the light-emitting bulb includes a light-emitting flashlight bulb.

22. The wand light of claim 18, wherein:

the base tube includes a sealed bottom end and an internal base-tube periphery sized and shaped for receiving the stored-energy unit through the base sleeve.

23. The wand light of claim 18, wherein:

the light tube includes a sealed top end and an internal light-tube periphery sized and shaped for receiving the light emitter through the light sleeve.

24. The wand light of claim 18, wherein:

the light tube includes a top-end lens.

25. The wand light of claim 18, wherein:

the sliding pivotal contact of the outside-pivot periphery of the light sleeve of the light tube with the inside-pivot periphery of the base sleeve of the base tube includes a pivot-connection lock with a tensional connector pin having a first seal cap proximate the first base-pin orifice and a second seal cap proximate the second base-pin orifice;

the light sleeve has two lock slots that are oppositely disposed circumferentially to receive the tensional connector pin;

the two lock slots have circumferential lengths to allow predetermined circumferential travel while preventing linear travel of the light sleeve in the base sleeve; and a tensioner for tensioning the first seal cap towards the second seal cap is positioned is positioned intermediate the two lock slots for moisture-proof attachment of the connector pin to the base sleeve.

26. The wand light of claim 25, wherein:

the tensioner is a machine-threaded bolt.

27. A wand light comprising:

a base tube having a base end and a light-attachment end;

a stored-energy unit in the base tube;

a positive electrical conveyance intermediate a positive portion of the stored-energy unit and at least one positive contact of a twist switch proximate the light-attachment end, a negative electrical conveyance intermediate a negative portion of the stored-energy unit and a negative contact of the twist switch proximate the light-attachment end, the base tube having a base sleeve with an inside-pivot periphery proximate the light-attachment end;

a light tube having a base-attachment end and a terminal end;

the light tube having a light sleeve with an outside-pivot periphery in sliding pivotal contact with the inside-pivot periphery of the base sleeve proximate the base-attachment end;

a positive light-circuit conveyance and a negative light-circuit conveyance positioned collinearly in the light tube;

a light emitter having a positive emitter lead connected to the positive light-circuit conveyance and a negative emitter lead connected to the negative light-circuit conveyance in the light tube;

a positive switch conveyance that is positioned in electrical communication intermediate the positive light-circuit conveyance and the positive contact of the twist switch by rotation of the light sleeve in the base sleeve;

a negative switch conveyance that is positioned in electrical communication intermediate the negative light-circuit conveyance and the negative contact of the twist switch by rotation of the light sleeve in the base sleeve;

a base-tube cap proximate the base end of the base tube;

a light-tube cap proximate the terminal end of the light tube;

moisture-proof sealing of the sliding pivotal contact of the outside-pivot periphery of the light sleeve of the light tube with the inside-pivot periphery of the base sleeve of the base tube;

a pivot-connection lock having a connector pin positioned intermediate a first base-pin orifice and a second base-pin orifice in the base sleeve;

the light sleeve having two lock slots that are disposed circumferentially opposite to receive the connector pin;

the two lock slots having circumferential length to allow predetermined circumferential travel of the light sleeve in the base sleeve;

the connector pin having moisture-proof attachment to the base sleeve;

the base-tube cap being moisture-proof attachable to the base tube to moisture-proof contain the stored-energy unit in the base tube removably;

the light-tube cap being moisture-proof attachable to the light tube to moisture-proof contain the circuit board in the light tube;

the base tube having an outside periphery with a color for predetermined lightness visibility;

the light tube having an outside periphery with a color for predetermined darkness visibility from light in the light tube; and the outside periphery of the light tube having linear ribs and grooves for twist-grasping and for light deflection.

* * * * *